US008640450B2

(12) United States Patent
Rafalski, Jr.

(10) Patent No.: US 8,640,450 B2
(45) Date of Patent: Feb. 4, 2014

(54) COMPRESSED FLUID MOTOR

(75) Inventor: Leroy J Rafalski, Jr., Hoffman Estates, IL (US)

(73) Assignee: St. Mary Technology LLC, St. Marys, OH (US)

( * ) Notice: Subject to any disclaimer, the term of this patent is extended or adjusted under 35 U.S.C. 154(b) by 575 days.

(21) Appl. No.: 12/206,713

(22) Filed: Sep. 8, 2008

(65) Prior Publication Data

US 2009/0064672 A1 Mar. 12, 2009

Related U.S. Application Data

(60) Provisional application No. 60/970,838, filed on Sep. 7, 2007.

(51) Int. Cl.
*F16D 31/02* (2006.01)
*F01B 1/00* (2006.01)

(52) U.S. Cl.
USPC ..... 60/370; 91/476; 91/493

(58) Field of Classification Search
USPC ..... 60/370; 91/481, 493, 248, 275, 476
See application file for complete search history.

(56) References Cited

U.S. PATENT DOCUMENTS

| | | | | |
|---|---|---|---|---|
| 2,122,676 | A | 7/1938 | Bourke | |
| 2,122,677 | A | 7/1938 | Bourke | |
| 2,172,670 | A | 9/1939 | Bourke | |
| 3,220,316 | A | 11/1965 | Kummerman | |
| 3,925,984 | A | 12/1975 | Holleyman | |
| 4,013,048 | A | 3/1977 | Reitz | |
| 4,094,227 | A | 6/1978 | King | |
| 4,106,391 | A * | 8/1978 | Wheeler | 91/481 |
| 4,203,351 | A | 5/1980 | Schwind | |
| 4,443,163 | A | 4/1984 | Gaithe | |
| 4,478,132 | A | 10/1984 | Braddock | |
| 4,507,918 | A | 4/1985 | Holleyman | |
| 4,512,291 | A | 4/1985 | Kirk | |
| 4,596,119 | A | 6/1986 | Johnson | |
| 4,598,628 | A | 7/1986 | Courtright | |
| 4,609,045 | A * | 9/1986 | Rogers | 91/275 |
| 4,876,991 | A | 10/1989 | Galitello, Jr. | |
| 4,889,035 | A * | 12/1989 | Goodnow | 91/275 |
| 4,957,074 | A | 9/1990 | Weissler, II et al. | |

(Continued)

FOREIGN PATENT DOCUMENTS

| | | | |
|---|---|---|---|
| JP | 2002-256803 | A | 9/2002 |
| WO | 2000-015964 | A1 | 3/2000 |

OTHER PUBLICATIONS

PCT Search Report and Written Opinion in corresponding PCT/US08/75656.
Patent Abstracts of Japan for JP 2002-256803 A (Uenishi Fujio).

(Continued)

*Primary Examiner* — Michael Leslie
(74) *Attorney, Agent, or Firm* — Vorys, Sater, Seymour and Pease LLP; William L. Klima

(57) ABSTRACT

A compressed fluid motor has a plurality of cylinders with a piston and a piston rod. A main bearing is concentric with a crankpin and coupled to a shaft. Compressed fluid on the piston pushes on the main bearing via its corresponding piston rod. Bearing guide plates hold the one or more piston rod in place on the main bearing. A timing and control mechanism controls flow of compressible fluid to press on the piston and turn the shaft to perform work.

32 Claims, 5 Drawing Sheets

(56) References Cited

U.S. PATENT DOCUMENTS

| | | | | |
|---|---|---|---|---|
| 5,327,863 | A | 7/1994 | Downton et al. | |
| 5,351,599 | A * | 10/1994 | Stoll | 91/1 |
| 6,065,440 | A | 5/2000 | Pasquan | |
| 6,598,392 | B2 | 7/2003 | Majeres | |
| 6,827,058 | B1 | 12/2004 | Falero | |
| 6,840,151 | B1 * | 1/2005 | Barker et al. | 91/485 |
| 7,100,493 | B2 | 9/2006 | Nomura | |
| 7,104,227 | B2 | 9/2006 | Roberts | |
| 7,328,682 | B2 | 2/2008 | Fisher | |
| 2004/0026145 | A1 | 2/2004 | Lan | |
| 2005/0224059 | A1 | 10/2005 | Negre et al. | |
| 2007/0101712 | A1 | 5/2007 | Negre et al. | |
| 2009/0013681 | A1 * | 1/2009 | Courtright | 60/327 |

OTHER PUBLICATIONS

Bourke Engine Documentary by Lois Bourke, Tesla Book Co., Greenville, TX 75403, Copyright 1968.

Hot Rod Magazine, The Bourke Two-Stroke a Revolutionary Engine by George Hill, Copyright 1954 by Trend, Inc. Los Angeles, CA, pp. 18-21 and 52 vol. 7. No. 7, Jul. 1954.

CBA-Series Scotch-Yoke. Pneumatic Actuators, Emerson Process Management product brochure, Bettis Bulletin # 20.00-4 Rev 9-02, Copyright 2002.

* cited by examiner

COMPRESSED FLUID MOTOR

CROSS-REFERENCE TO RELATED APPLICATIONS

This application claims priority benefits under 35 U.S.C. §§119(e) and 120 to U.S. provisional application No. 60/970,838 filed on Sep. 7, 2007. Such provisional application is incorporated herein by reference as if set forth in full herein.

BACKGROUND OF THE INVENTIONS

1. Technical Field

The present inventions relate to motors and, more particularly, relate to compressed fluid motors.

2. Description of the Related Art

Public awareness and recent legislation has brought upon a need for a clean and environmentally responsible motor technology. Fuel burning engines are designed to consume refined fossil fuels but still produce unhealthy emissions. Higher fuel costs and maintenance costs are now associated with fuel burning engines. Previous attempts with fuel engines using straight line force to convert to rotary motion has been offered but with unsuccessful results. The most popular is the Bourke engine. This gasoline engine never achieved recognition and still would rely on fossil fuels as the source of power.

Electric motors are efficient but use large amounts of power for continuous usage. The limiting factor appears to be the storage of heavy battery cells for mobile applications. Recharging requires hours and the range of travel does not allow for extended distances. The spent storage batteries are a potential hazard to the environment if not disposed of properly. High expenses associated with constant recharging, maintenance and eventual battery replacement would be required. An alternative motor is required because of these shortcomings in current technology.

SUMMARY OF THE INVENTIONS

A compressed fluid motor with a rotational shaft produces 360 degree axial motion. The compressed fluid motor can be constructed with horizontally opposed cylinders, vertically opposed cylinders, or both. This unique arrangement has been found to be the most effective way of imposing effective linear motion from the cylinder piston rods into a rotation mass to allow a shaft or more than one shaft to move or turn a load. The properly designed compressed fluid motor will achieve full advantage of converting linear motion into rotational motion through the shaft. The torque potential of the rotating shaft will be similar to the output of the compressed fluid cylinders.

An object of the present inventions is to provide a viable alternative to electric motors and combustible engines. The compressed fluid motor can be used for any application that requires rotational motion to perform a duty. The compressed fluid motor could be as useful as electric motors or gas engines of similar size to perform the same work. This compressed fluid motor could be utilized into new product designs and advanced applications.

The details of the preferred embodiments and these and other objects and features of the inventions will be more readily understood from the following detailed description when read in conjunction with the accompanying drawings wherein:

DETAILED DESCRIPTION OF THE PREFERRED EMBODIMENTS

The present invention relates to a compressed fluid motor with a rotational shaft to produce motion as an alternative to all electric motors and combustible engines for current and future applications. Electric motors of any power usage or any combustible type engine could be replaced with this compressed air motor. This movement would be similar to that of a shaft on an electric motor or the shaft of a combustible engine. The compressed fluid medium will be any compressible gas to include but not limited to; air, nitrogen, propane, natural gas, steam, carbon dioxide, etc. This also applies to any compressible liquid to include but not limited to; hydraulic fluid, water and/or any other compressible liquid deemed safe and appropriate for this application. The pressures for this compressed fluid medium would be from zero PSI (Pounds per Square Inch) to any pressure that could be used to exert force and create motion in this compressed fluid motor.

Figure 1:
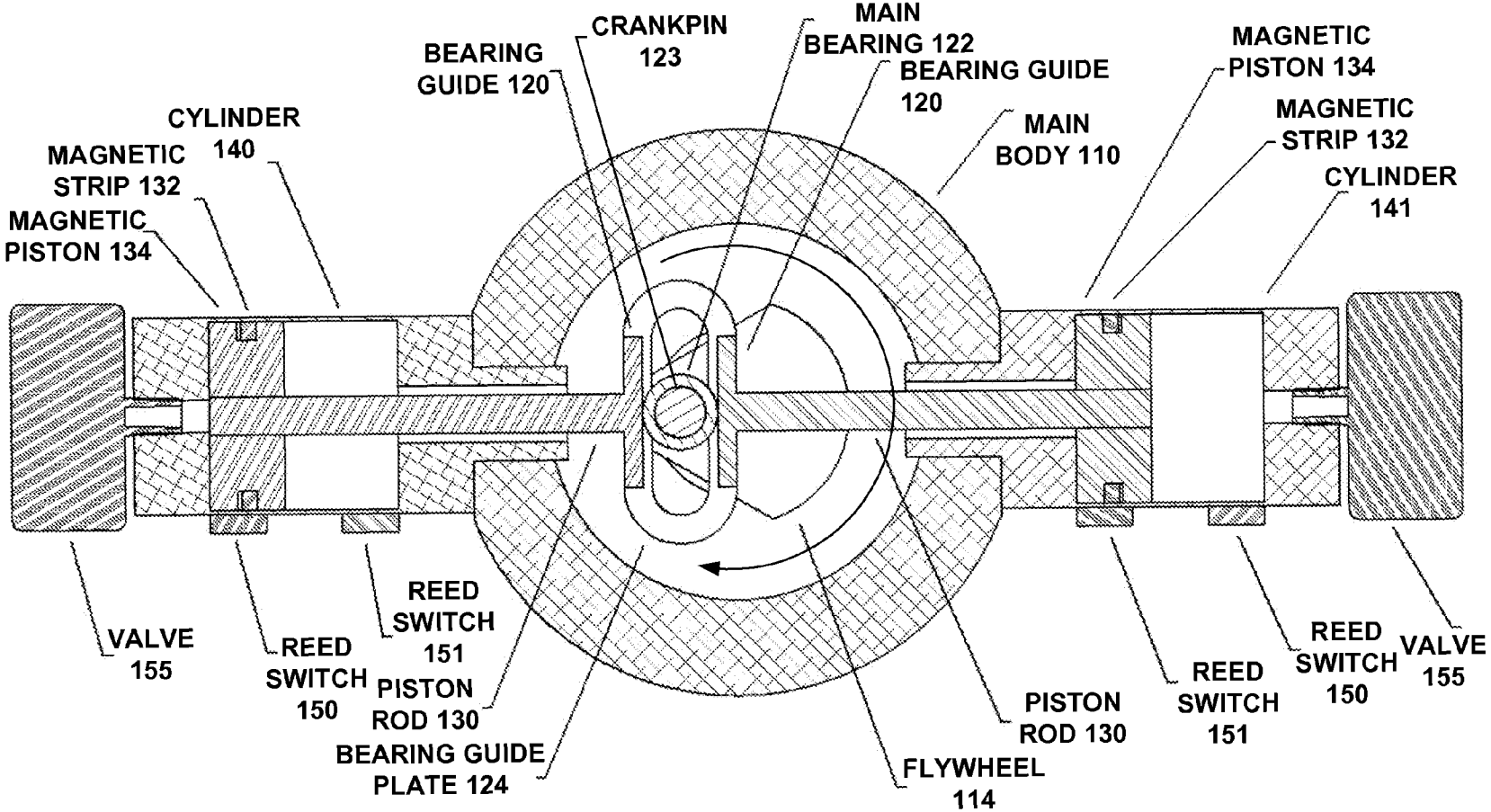
FIG. 1 illustrates a cutaway, side view of the compressed fluid motor according to an embodiment of the present inventions.
Figure 2:
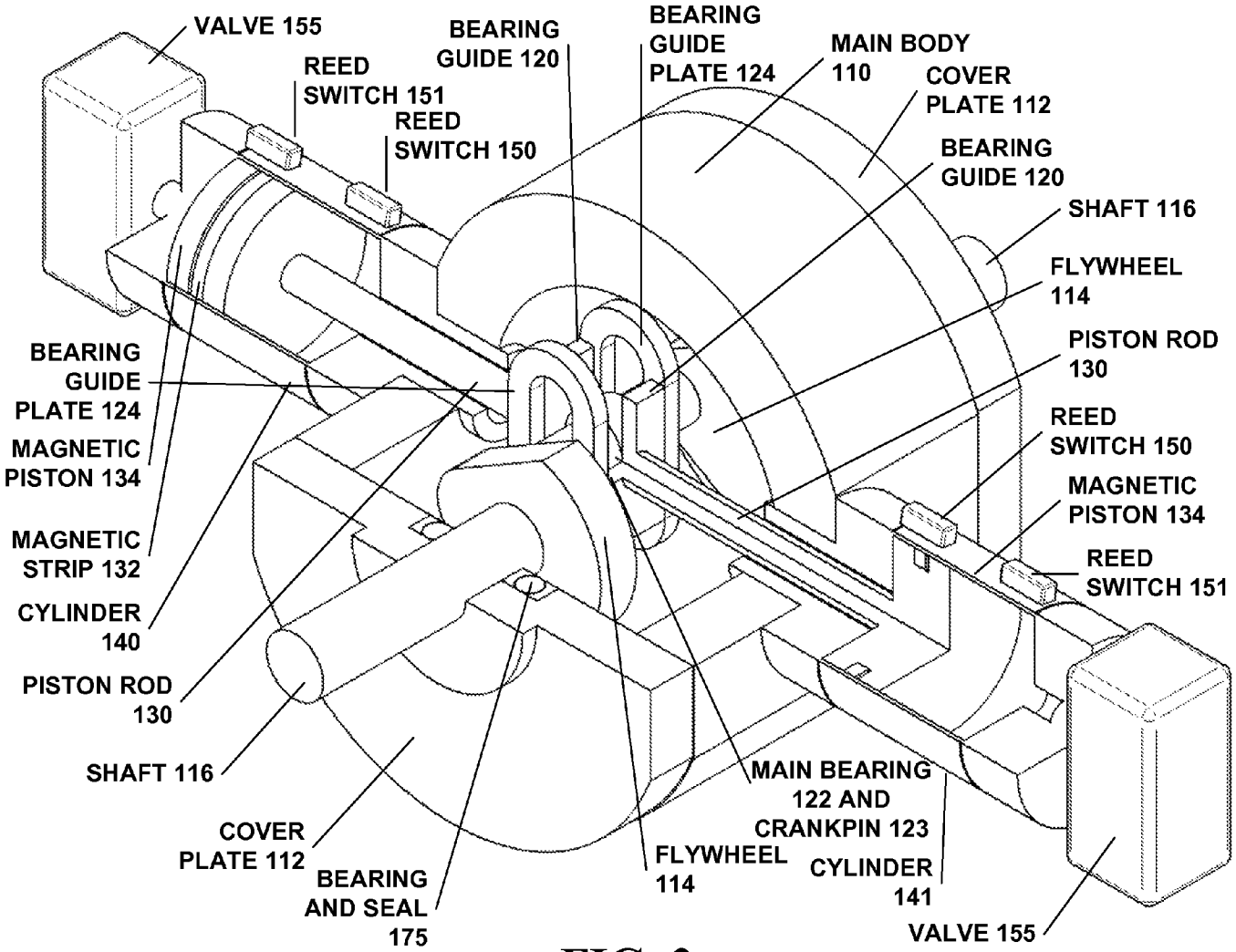
FIG. 2 illustrates a cutaway, isometric view of the compressed fluid motor according to an embodiment of the present inventions.

The motor is comprised of common and unique components to impart rotation to a shaft or shafts. The following components and drawings explain the motor:

FIG. 1 illustrates a cutaway, side view of the compressed fluid motor according to an embodiment of the present inventions. FIG. 2 illustrates a cutaway, isometric view of the compressed fluid motor according to an embodiment of the present inventions.

The main body 110 is the support structure for the inner and outer workings of the compressed fluid motor. The main body 110 can be any shape or size to accommodate the interior and/or exterior components for a complete or sub assembled unit. The material of the body can be any plastic, wood, metal and/or any man made or natural material that can be effectively used for this intended purpose. The compressed fluid cylinders will be mounted coaxially and oppositely in relation to the body and the shaft 116. The final design may be one or more shafts.

The cylinders may be of any design in regards to shape or volume as to have a cylinder body, piston body, piston rod 130, pressure ports and seals or rings to compress the above mentioned fluid mediums. The method of connection of the cylinders to the main body 110 can be but not limited to threading, bolting, welding, casting into a single piece, any means necessary to connect cylinders in the same arrangement as this compressed fluid motor. The cylinders could be special purpose for this design or made or purchased in a commercial market. The cylinders are of a double acting design, however, only in pressurized in push, as the piston rods 130 are facing each other. This creates a desirable mechanical advantage as the cylinder output forces are greater when pressure is applied at the cap end (pressure on full face of piston body). The cylinders can be used in any combination with a preference of multiples of two cylinders. A compressed fluid motor of this design can be assembled with two, four, six, eight, etc. number of cylinders as deemed appropriate for the desired power output.

The head end port of the cylinder may be used, but not limited to, for extra force through pressurization or vacuum to assist the compressed fluid motor to reverse or forward motion. The pressurized cylinder piston rods 130 will cause motion to the main bearing 122, crankpin 123, flywheels 114 and shafts 116 by means of bearing guides 120 and bearing guide plates 124. Each piston rod 130 will be connected to a bearing guide 120. The method of connection can be but is not limited to threading, welding, pinning, casting of a one-piece component. The bearing guides 120 rest on the main bearing 122 which is mounted onto a crankpin 123.

The main bearing 122 will be designed to allow full rotation in clockwise or counter-clockwise at the will of the forces involved. The bearing guides 120 will be designed to withstand the forces of compression of the sliding force of the inner works. The crankpin 123 is connected to two flywheels 114 of the same proportion for full balance. The crankpin 123 will be designed with an appropriate material of sufficient size and tapered ends for positive location into the flywheels 114. The flywheels 114 will be of sufficient design to withstand the forces of the compressed fluid cylinder forces and transfer the linear power exerted onto the crankpin 123 to turn the shaft 116 or shafts 116 for a full 360 degrees in slow or rapid succession. This will be a full rotation of the shaft 116.

The shaft 116 or shafts 116 will be mounted into the center of each flywheel 114 and will be of sufficient length to be suspended by double row bearings and seals 175 then pass through a cover plate 112 to connect to any type of device to harness the rotational motion of the shaft 116 or shafts 116. The bearing plates 124 allow the main bearing 122 to rotate freely and the bearing guides 120 to move back and forth in a controlled synchronized manner.

Minor components for assembly may include machine screws, o-rings or flat seals, bearings, pins, etc. The final design may or may not contain any number of solutions to meet the requirements to safely contain the inner and/or outer workings of this compressed fluid motor. The materials chosen for each component could be any material man made or natural materials as to meet the requirements of the design. Any combination of said parts which can be arranged to perform this same function may be considered an advance of this primary design.

Control components are commercially available and sufficient information of selecting these devices is available. The control components are as follows but not limited to: Two solenoid operated directional control valves 155. Two cylinders 140 and cylinder 141 of equal design with same bore and stroke. Two reed switches 150 normally open mounted at cap end of each fluid cylinder. Two reed switches 151 normally closed mounted at head end of each fluid cylinder. Two relays to continue electrical current through a full power stroke. Fittings of sufficient size and pressure rating to connect all devices. Tubing for distribution of any compressed fluid medium will be any compressible gas to include but not limited to; air, nitrogen, propane, natural gas, steam, carbon dioxide, etc. This also applies to any compressible liquid to include but not limited to; hydraulic fluid, water and/or any other compressible liquid deemed safe and appropriate for this application. The tubing could be but not limited to plastics or metal of sufficient pressure rating.

Compressed fluid is controlled through solenoid operated directional control valves 155 at cylinder 140 and cylinder 141. This is timed and controlled release of fluid into each cylinder 140 and 141. The magnetic pistons 134 and piston rods 130 are connected through bearing guides 120 and bearing guide plates 124. The linear motion is converted into rotational motion with the bearing guides 120 pushing the main bearing 122 into a 360 degree controlled and balanced motion into the crankpin 123 and flywheels 114. The shaft 116 or shafts 116 at the center of the flywheels 114 would be connected to the work. The work could be a pulley, shaft or other type of coupler. The primary principle of operation is achieved through converting the linear motion of compressed fluid cylinders 140 and 141 into a main bearing 122 to cause a rotational force into the flywheel 114 and shaft 116 or shafts. The arrangement can be modified to perform the same functions with design changes. The actual size of this compressed fluid motor can also be scaled up or down to fit the parameters of the work required. The inner workings (main bearing 122, crankpin 123, flywheels 114, shafts 116, bearing guides 120, and bearing guide plates 124) in one embodiment are individual components. The shaft can comprise a removable flywheel and removable crankpin coupled with a key and keyway for maintenance or customization. This same device could be achieved in another embodiment by making a single, one piece, flywheel 114, crankpin 123 and shaft 116. This assembly could be made of wood, plastic, metal and any other man made or natural materials.

The magnetic pistons 134 are at a fixed distance apart and move as one part connected by the piston rods 130, bearing guides 120 and bearing guide plates 124 as shown in FIG. 1. As the assembly moves back and forth the bearing guides push the main bearing into a 360 degree motion on a fixed path around the centerline of the shaft 116. The main bearing 122, crankpin 123, flywheels 114 and shafts 116 move as one assembly. This assembly converts linear motion from the pistons into a rotary force into the main bearing and assembly.

Figure 3:
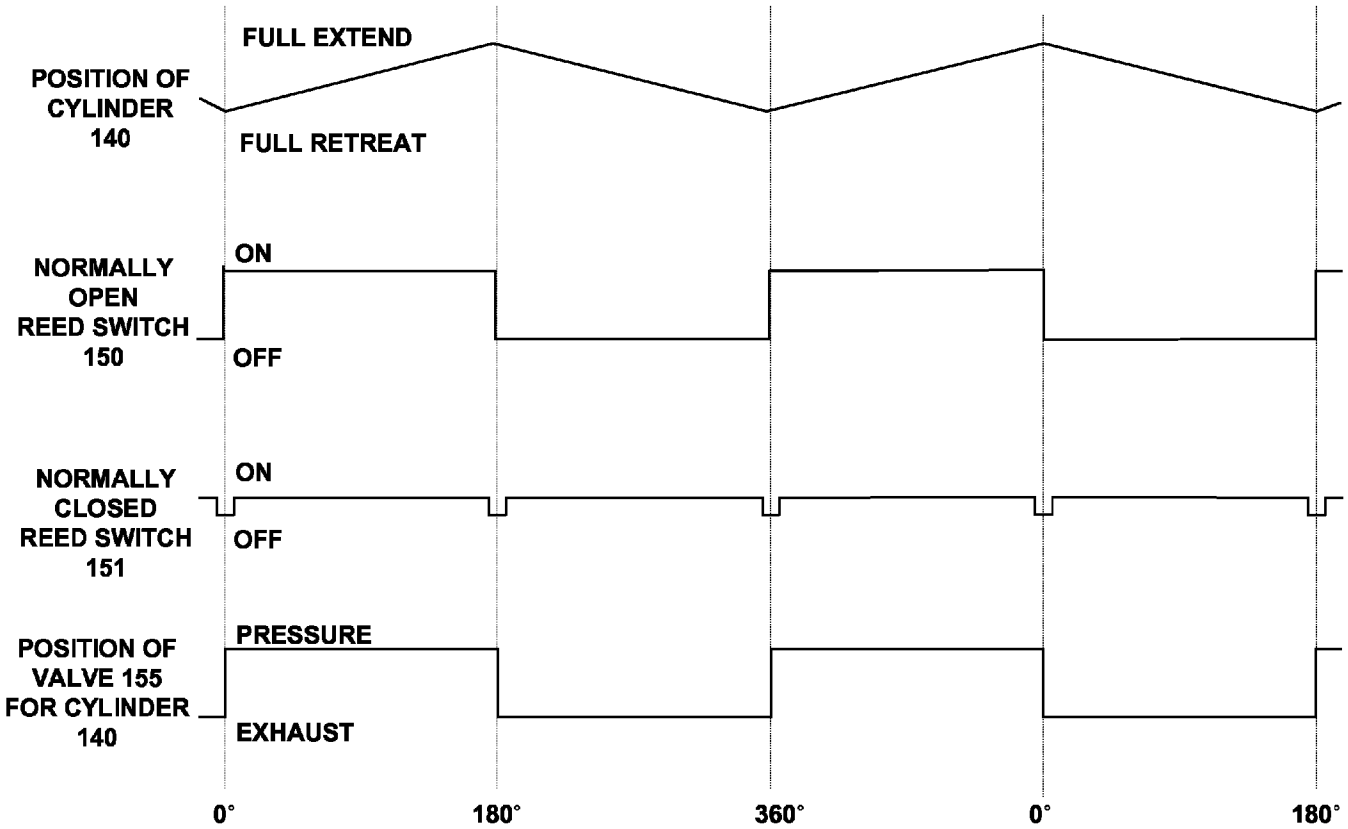
FIG. 3 illustrates a timing diagram of the compressed fluid motor operation for left cylinder 140 according to an embodiment of the present inventions.
Figure 4:
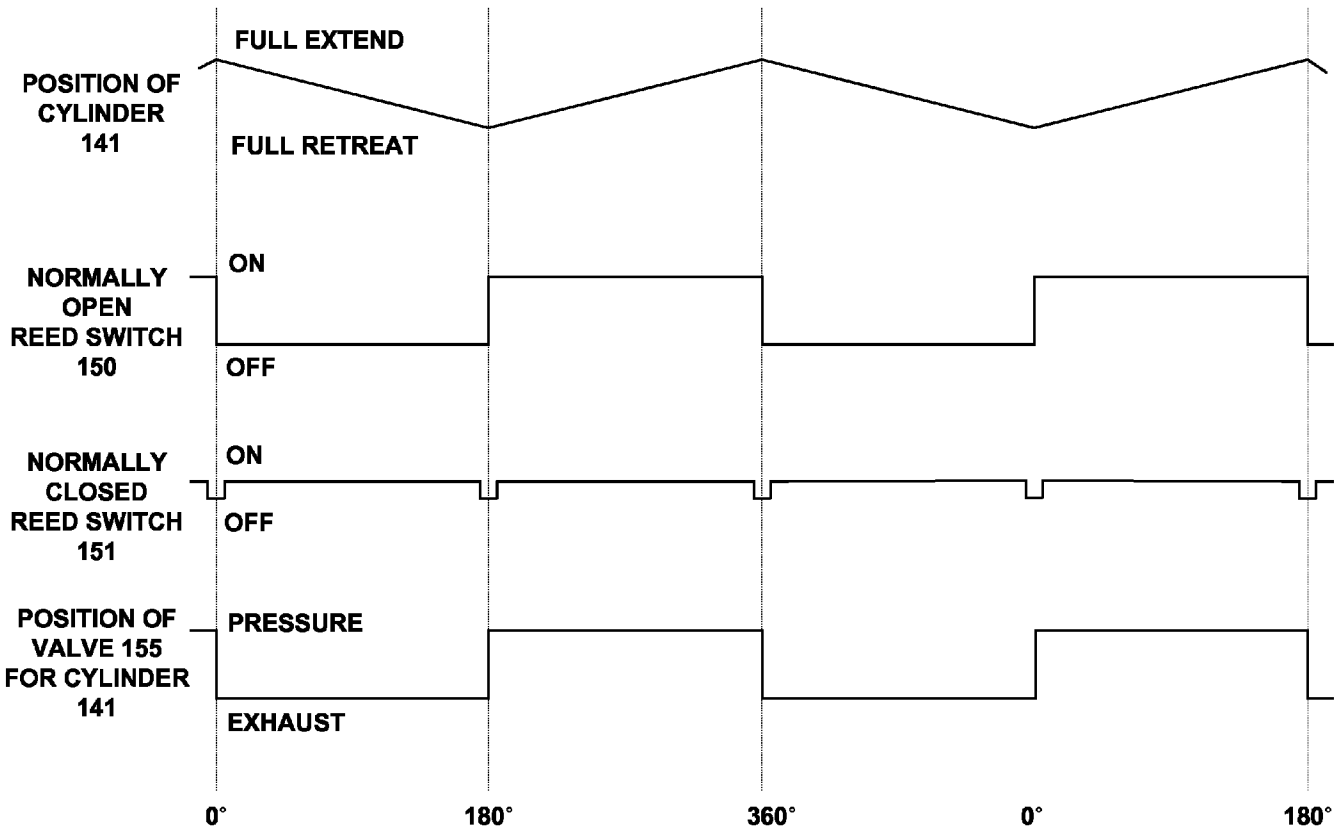
FIG. 4 illustrates a timing diagram of the compressed fluid motor operation for right cylinder 141 according to an embodiment of the present inventions.

FIG. 3 illustrates a timing diagram of the compressed fluid motor operation for left cylinder 140 according to an embodiment of the present inventions and FIG. 4 illustrates a timing diagram of the compressed fluid motor operation for the right cylinder 141 according to an embodiment of the present inventions.

The magnetic piston 134 located in cylinder 140 is at the full retract position. The magnetic strip 132 in cylinder 140 closes the normally open reed switch 150 on cylinder 140. The reed switch 150 on cylinder 140 sends an electrical signal to the relay to maintain power to the valve 155 on cylinder 140. The valve 155 on cylinder 140 opens and allows pressure into cylinder 140 to advance the magnetic piston 134 in cylinder 140 forward. The main bearing 122 and crankpin 123 begins to rotate around the centerline of the shaft 116 in FIG. 2. The magnetic piston 134 of cylinder 140 advances to a full extend position. The normally closed reed switch 151 deactivates the relay and power to the valve 155 on cylinder 140. The pressure is removed and the valve 155 on cylinder will exhaust and allow the pressure to escape. The main bearing 122, crankpin 123, flywheels 114 and shaft 116 have moving 180 degrees from the start position. The magnetic piston 134 located in cylinder 141 is at the full retract position. The magnetic strip 132 in cylinder 141 closes the normally open reed switch 150 on cylinder 141. The reed switch 150 on cylinder 141 sends an electrical signal to the relay to maintain power to the valve 155 on cylinder 141. The valve 155 on cylinder 141 opens and allows pressure into cylinder 141 to advance the magnetic piston 134 in cylinder 141 forward. The main bearing 122 and crankpin 123 begins to rotate around the centerline of the shaft 116 in FIG. 2. The magnetic piston 134 of cylinder 141 advances to a full extend position. The normally closed reed switch 151 deactivates the relay and power to the valve 155 on cylinder 141. The pressure is removed and the valve 155 on cylinder will exhaust. The main bearing 122, crankpin 123, flywheels 114 and shaft 116 have moving 360 degrees from the start position. The pressure cycle, start position, begins again for cylinder 140.

An electrical power source would be necessary to allow the reed switches 150 and 151, relays and valves 155 to activate for this design. Advanced designs of this compressed fluid motor may add or remove the electronics or shift the valve 155 through auxiliary fluid lines.

Figure 5:
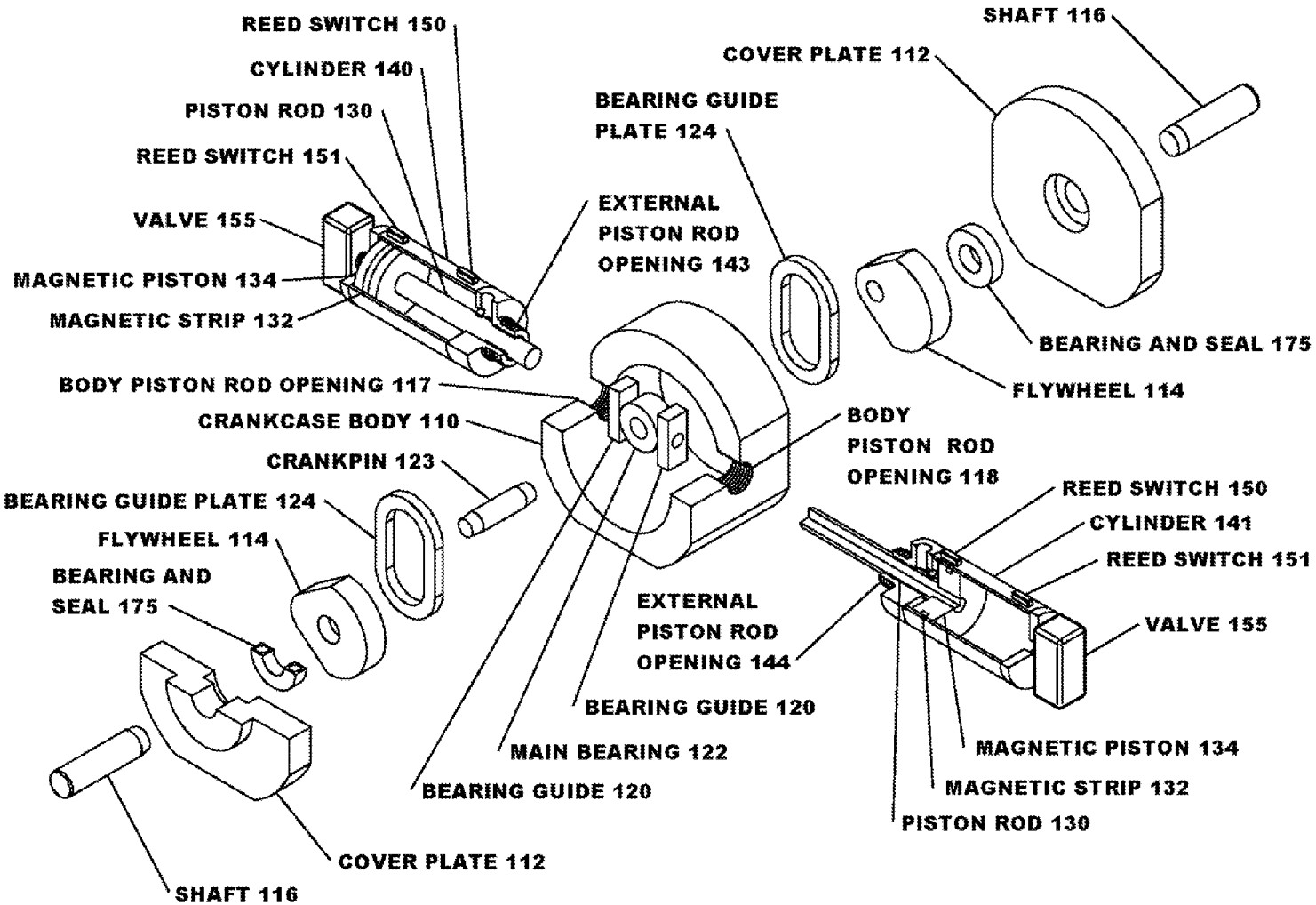
FIG. 5 illustrates an exploded view of the cutaway, isometric view of the compressed fluid motor of FIG. 2.

FIG. 5 illustrates an exploded view of the cutaway, isometric view of the compressed fluid motor of FIG. 2. Like members in FIG. 2 are illustrated in FIG. 5 with like reference numerals. External piston rod openings 143 and 144 are labeled in this exploded view. Also, body piston rod openings 117 and 118 are labeled in this exploded view. The one external piston rod opening 143 of the one external cylinder 140 is secured onto the body piston rod opening 117 of the crankcase body 110. The other external piston rod opening 144 of the other external cylinder 141 is secured onto the other body piston rod opening 118 of the crankcase body 110. While threads are illustrated in the one embodiment of FIG. 5, as discussed above with respect to FIGS. 1 and 2, a removable connection of the external cylinders 140 or 141 to the crankcase body 110 can be accomplished in other ways such as bolting. As discussed above with respect to FIGS. 1 and 2, external cylinders 140 and 141 can be commercially available cylinders purchased in a commercial market.

Other components not mentioned are a storage device for mobile applications. This storage device could be a compressed fluid vessel or tank. It is also possible to produce compressed fluid at the point of use in a mobile or stationary application. A safety lockout device is recommended. This device would halt all pressure to the compressed fluid motor and all components in the circuit.

The use of the word "motor" is relevant to the understanding and description of this device. The word "motor" implies a device to move objects at a controllable and sustainable rotating motion. A "fluid motor" best describes what the device is and by what means it operates. Similar devices that use vanes or impellers use the word "motor" to describe their device. The comparison of the electric motor vs. the internal combustion engine would support the description of this device to be considered a "motor" as it turns or spins around the shaft 116 but does not consume, by ignition, the power source to induce the rotating motion.

Pressure for full stroke (advantage over a gasoline type engine): The mechanical advantage of this motor design is by the use of straight line motion into pushing the main bearing 122 into a continuous 360 degree motion. This controlled motion has a distinct advantage over the typical gasoline engine by applying the pressure through the full revolution. A gasoline engine applies pressure to the top of the piston only at the highest point in the cylinder. This compressed fluid motor applies pressure for the full length of the piston travel. This sustained pressure allows this motor to achieve higher torque output then any gasoline engine equal in size and weight. The revolutions per minute (RPM) and torque values are controlled and repeatable for practical work to be performed. Higher torque can be achieved by allowing the compressed air into the cylinder for the full stroke length. Higher rotational speed can be achieved with higher pressures, quick acting valves and switches.

Recapturing of compressed fluid once passed through the compressed fluid motor would be useful for other features or motors in a secondary system for regeneration. The fluid would pass through the compressed fluid motor and could be returned to a secondary low pressure tank. The advantage would be that it is easier to compress fluid from 100 PSI (7 bar) to 200 PSI (14 bar) then to go from 14.7 PSI (1.03 bar) to 200 PSI (14 bar). The 200 PSI (14 bar) would also be available as a reserve for startup or extra boost to the system.

The process of storing compressed air and reintroducing compressed fluid from the motor would be relevant for maximum efficiency of an enclosed circuit. The compressed fluid motor could be allowed to continually operate and be driven by a transmission, pulley, belt or other means for the purpose of placing compressed fluid back into the system. Such could be applied to regenerative braking through the use of valves 155 placed in the circuit with an advantage of increased range and usefulness of the compressible fluid motor in mobile applications.

The use of electronics over mechanical controls for the compressed fluid motor provides flexibility. The converting of linear motion into rotational motion requires is novel and performs well in bench testing. This design is not complex but underutilized as a prime mover. The prototype compressed fluid motor (bench tested without a load) was capable of 750 revolutions per minute (RPM) at 40 PSI (2.8 bar). The bearing and seal 175 were rated for 10,000 RPMs and the cylinders 140 and 141 were rated for 250 PSI (17.5 bar). Limitations for this bench test were the compressor (150 PSI or 10.5 bar maximum) which could be overcome with a 3000 PSI (210 bar) tank and pressure regulator set to 250 PSI (17.5 bar).

Mechanical valve arrangement: The compressed fluid can be introduced into the cylinders 140 and 141 by means of mechanical controls. A mechanical intake valve would open and allow pressure into the cylinder 140 and 141, push the piston through full stroke and then close to release the pressure through an exhaust valve. This would be done with a push rod located through the case and timed to the position of the main bearing 122 or flywheels 114. This assembly would be beneficial for fixed applications that would not require the flexibility that electronics would provide.

The opening and closing of the valves 155 can be adjusted to achieve and maintain the ideal operation and requirements of the compressed fluid motor. The valve 155 timing would be preset for maximum speed and/or maximum torque for desired operation.

Further developments of this fluid motor would be to add or remove electrical components for desired fluid motor operation. Electrical controls could be replaced or supplement with air controlled valves, mechanical valves or any other means to pressurized or exhaust the cylinders.

Conclusions and further advantages. These cycles are completed in rapid succession and will create useful work similar to that of a combustion engine or an electric motor. The compressed fluid motor will has the torque characteristics of an electric motor with pressure developed through the entire cycle and movement of the shaft. Maintaining pressure into the cylinders will allow for more torque and revolutions per minute. The power derived from this compressed fluid motor will produce more power than any combustion engine of equivalent cylinder volume. This compressed fluid motor could be useful for mobile or stationary applications as an alternative to an electric motor and/or internal combustion engine. The present invention provides a compressed fluid motor with power generation of a low weight to power ratio in favor of the mechanical advantage of converting linear motion into rotational motion.

Although the inventions have been described and illustrated in the above description and drawings, it is understood that this description is by example only, and that numerous changes and modifications can be made by those skilled in the art without departing from the true spirit and scope of the inventions. Although the examples in the drawings depict only example constructions and embodiments, alternate embodiments are available given the teachings of the present patent disclosure. For example, although examples for compressed fluid are disclosed, the inventions are also applicable to suction or vacuum of fluids instead of compression of fluids.

What is claimed is:

1. A compressed fluid motor, comprising:

a crankcase;

a crankshaft rotatably disposed within the crankcase;

a plurality of cylinders associated with the crankcase;

a plurality of pistons, each piston slidably disposed within each cylinder;

a plurality of piston rods each connecting each piston to the crankshaft;

a plurality of electric control valves each associated with each cylinder;

an electric control configured to control timing and operation of the electric control valves, the electric control being connected to the plurality of electric control valves and configured to sequentially operate and pressurize the cylinders to operate the compressed fluid motor.

2. A compressed fluid motor according to claim 1, wherein the piston rods are fixedly coupled to the pistons so that the pistons do not pivot upon rotation of the crankshaft.

3. A compressed fluid motor according to claim 1, wherein the crankcase is provided with a bearing guide and a main bearing configured to provide rotational motion to the crankshaft.

4. A compressed fluid motor according to claim 1, wherein the compressible fluid is chosen from the group consisting of air, nitrogen, propane, natural gas, steam, and carbon dioxide.

5. A compressed fluid motor according to claim 1, wherein each piston comprises a magnetic piston strip; and the valve control comprises reed switches and solenoid valves adapted to each cylinder to cooperate with the magnetic piston strip of the respective piston to time and control the flow of the compressible fluid.

6. A compressed fluid motor according to claim 1, wherein the crankshaft further comprises a flywheel.

7. A compressed fluid motor according to claim 1, wherein the plurality of cylinders are configured as an opposing pair of cylinders.

8. A compressed fluid motor according to claim 1, wherein each control valve is coupled to each cylinder.

9. A compressed fluid motor according to claim 8, wherein each cylinder comprises a cylinder port; and a respective control valve is mounted externally on each respective cylinder assembly at the respective cylinder port.

10. A compressed fluid motor according to claim 3, wherein the crankshaft comprises a removable flywheel and removable crankpin.

11. A compressed fluid motor according to claim 1, wherein the compressed fluid motor is a pneumatic motor.

12. A compressed fluid motor according to claim 10, wherein the crankshaft comprises a removable flywheel, removable crankpin, bearing guide, and a main bearing.

13. A compressed fluid motor according to claim 1, wherein each of the cylinders are separate components connected to the crankcase.

14. A compressed fluid motor according to claim 13, wherein each of the cylinders are configured to be removably connected to the crankcase.

15. A compressed fluid motor according to claim 14, wherein each of the cylinders are mechanically connected to the crankcase.

16. A fluid motor, comprising:

a crankcase;

a crankshaft rotatably disposed within the crankcase;

a plurality of cylinders connected to the crankshaft;

a plurality of pistons each slidably disposed within each of the plurality of cylinders;

a plurality of piston rods each connecting each piston to the crankshaft;

a plurality of electric control valves each operationally connected to each cylinder;

an electric sensor configured for detecting the position of the pistons within the cylinders; and an electric valve control unit connected to the electric sensor and electric control valves, the electric control unit configured to receive the detecting signal from the electric sensor and generate an electric control signal to open and close the electric control valves in a timed sequence based on detected positions of the pistons to selectively supply and pressurize the cylinders with a compressible gas to drive the crankshaft of the multiple cylinder fluid motor.

17. A motor according to claim 16, wherein the electric control valve is configured to sequentially pressurize an upper portion of the cylinder located above the piston.

18. A motor according to claim 17, wherein the electric control valve is directly connected to an upper portion of the cylinder.

19. A motor according to claim 16, wherein the electric sensor is configured to detect the location of at least one piston at different positions within a particular cylinder.

20. A motor according to claim 19, wherein the electric sensor is a plurality of electric sensors.

21. A motor according to claim 20, wherein each electric sensor is associated with each cylinder and spaced apart a distance along a length of the cylinder.

22. A motor according to claim 16, wherein each electric control valve is operationally connected to an upper portion of each cylinder located above the piston.

23. A motor according to claim 22, wherein each electric control valve is connected via a conduit to each cylinder.

24. A motor according to claim 23, wherein each electric control valve is connected to a cylinder head of each cylinder.

25. A motor according to claim 24, wherein each electric control valve is connected at a top center of each cylinder head of the cylinder.

26. A motor according to claim 16, wherein the electric sensor is a reed switch associated with at least one cylinder and a magnet connected to the piston slidably disposed within the at least one cylinder and the magnet configured to activate the reed switch.

27. A motor according to claim 19, wherein the electric sensor is a plurality of spaced apart reed switches associated with at least one cylinder and a magnet connected to the piston slidably disposed within the at least one cylinder and the magnet configured to sequentially activate the reed switches.

28. A motor according to claim 26, wherein the at least one reed switch is mounted on an external surface of the respective at least one cylinder, and spaced apart along a length of the respective at least one cylinder.

29. A motor according to claim 27, wherein a lower reed switch is configured to be normally open and on at 0°, off at 180°, and on at 360° based on the position of the piston within the cylinder.

30. A motor according to claim 27, wherein an upper reed switch is configured to be normally closed and momentarily turned off and on at 0°, 180°, and 360° based on the position of the piston within the cylinder, each for a short duration.

31. A motor according to claim 16, wherein the electric control is configured to operate the electric control valves to provide pressure at 0°, exhaust at 180°, and pressure at 360° based on the position of the particular piston in the cylinder.

32. A motor according to claim 16, wherein at least two of the cylinders are horizontally opposed.

* * * * *